United States Patent [19]

Young et al.

[11] Patent Number: 4,965,415

[45] Date of Patent: Oct. 23, 1990

[54] MICROENGINEERED DIAPHRAGM PRESSURE SWITCH

[75] Inventors: Donald C. Young, Pangbourne; Philim B. Daniels, Hounslow, both of England

[73] Assignee: Thorn Emi plc, London, England

[21] Appl. No.: 324,413

[22] Filed: Mar. 16, 1989

[30] Foreign Application Priority Data

Mar. 17, 1988 [GB] United Kingdom ..... 8806383

[51] Int. Cl.[5] ..... H01H 35/34

[52] U.S. Cl. ..... 200/83 N; 200/83 P; 357/26; 361/283

[58] Field of Search ..... 361/283; 200/83 P, 83 N, 200/83 Y; 357/26; 73/723, 724; 340/626; 307/118; 338/42, 5; 337/320, 326

[56] References Cited

U.S. PATENT DOCUMENTS

| | | | |
|---|---|---|---|
| 3,689,719 | 9/1972 | Phillips | 200/83 P |
| 3,717,861 | 2/1973 | Wright, Jr. | 200/83 N |
| 3,723,684 | 3/1973 | Greenwood | 200/83 N |
| 4,365,225 | 12/1982 | Olsen | 337/107 |
| 4,586,109 | 4/1986 | Peters | 73/724 |
| 4,670,969 | 6/1987 | Yamada | 357/26 |
| 4,672,849 | 6/1987 | Hoshino | 361/283 |
| 4,784,721 | 11/1988 | Holmen | 357/26 |
| 4,829,822 | 5/1989 | Imai | 338/5 |

FOREIGN PATENT DOCUMENTS

| | | |
|---|---|---|
| 1362485 | 8/1974 | United Kingdom . |
| 1501857 | 2/1978 | United Kingdom . |
| 1543271 | 3/1979 | United Kingdom . |

*Primary Examiner*—Gerald P. Tolin

*Attorney, Agent, or Firm*—Fleit, Jacobson, Cohn, Price, Holman & Stern

[57] ABSTRACT

A microengineered pressure actuated switch includes a domed diaphragm having a snap-action response between defined states ($d_1$, $d_5$) of the diaphragm. This response is to an applied pressure differential across the diaphragm. The diaphragm is supported on a substrate of semiconductor material. In a method of making such a switch, a layer of inorganic material is provided on one side of a substrate of semiconductor material. Semiconductor material is removed from the substrate such that a defined region of the layer is not in contact with the semiconductor material, this defined region forming the diaphragm. The layer of inorganic material is so stressed that after semiconductor material is removed, the layer assumes a domed configuration and incorporates a pre-bias in the direction of doming.

6 Claims, 3 Drawing Sheets

MICROENGINEERED DIAPHRAGM PRESSURE SWITCH

This invention relates to a pressure actuated diaphragm switch and to a method of manufacture thereof.

It is known to provide pressure transducers formed on silicon substrates. U.S. Pat. No. 4,586,109, for example, discloses a silicon capacitive pressure sensor comprising a pair of conductive semiconductor plates separated by a layer of material comprising essentially the fused oxide of the material from which the plates are made. One (or, possibly both) of the plates is configured into a pressure-responsive diaphragm. Pressure-induced deflection of the diaphragm varies the distance between the two plates, thereby changing the capacitance of the sensor. Such change in the capacitance of the sensor may be monitored, using suitable circuitry, to produce a varying analogue signal as the pressure changes.

However, such a pressure transducer cannot be directly used as a switch to be operated when a defined pressure is obtained because the diaphragm is planar and consequently has only one equilibrium state i.e. its flat form. When the diaphragm is pressurized and stretched it is deformed and may make electrical contact but the switching point at which this would occur is notoriously difficult to predict and reproduce because of contact resistance. Furthermore, on pressure reduction, provided that the elastic limit has not been reached, the planar diaphragm always returns to its planar rest state.

One method of configuring such a pressure transducer into a switch is to use an electronic comparator circuit; the circuit compares the analogue output of the transducer with a threshold value corresponding to the aforementioned defined pressure and the necessary switching procedure takes place when the analogue output reaches the threshold value. However, there are circumstances in which the use of such an electronic circuit would be undesirable, e.g. the switch may be in a hazardous or explosive environment where the risk of electronic failure or danger due to the complexity of the comparator circuit is too great; the switch may be at a great distance from the main circuit, such as in oil wells, sea beds etc.; there may be a constraint on the size of the switch; or simply that the cost involved would be too great.

It is accordingly an object of the present invention to provide a microengineered pressure actuated diaphragm switch which at least alleviates some of the difficulties outlined herein. It is a related object of the present invention to provide a method of manufacturing a microengineered pressure actuated diaphragm switch.

According to a first aspect of the present invention, there is provided a micro-engineered pressure actuated switch including a domed diaphragm having a snap-action response between defined states of said diaphragm, said response being to an applied pressure differential across said diaphragm, wherein said diaphragm is supported on a substrate of semiconductor material.

Switches according to the present invention are precise and reproducible and can provide a simple microengineered mechanical changeover contact without complicated electronic circuits.

Preferably said diaphragm is biased resiliently in the direction of doming and said defined states include a first state and a second state, whereby, in use, said diaphragm is displaced to said second state by the application of pressure and returns to said first state upon removal of the applied pressure. Preferably said second state is stable with respect to a change in deflection of the diaphragm in one sense and unstable with respect to a change in deflection of the diaphragm in the opposite sense, said diaphragm remaining in said second state only when there is an applied pressure differential across said diaphragm. The extent of deflection of said diaphragm when pressure is applied may be limited by a backing member.

Preferably a first electrical contact is provided on said backing member and a second electrical contact is provided on said diaphragm so as to cooperate with said first electrical contact, to form an electrical switch. Preferably said first and second electrical contacts are in contact when said diaphragm is in said second state.

Said diaphragm may consist of a first and a second layer of inorganic material, said first layer having a different thermal expansion coefficient from said second layer.

According to a second aspect of the present invention, there is provided a method of making a pressure actuated switch including a domed diaphragm having a direction of doming and a snap-action response between defined states of said diaphragm, the method including the steps of providing on one side of a substrate of semiconductor material a layer of inorganic material and removing semiconductor material from said substrate such that a defined region of said layer is not in contact with semiconductor material of said substrate, said defined region forming said diaphragm; the method further comprising the step of so stressing said layer, that said layer assumes, after said step of removing semiconductor material from said substrate, a domed configuration and incorporates a pre-bias in said direction of doming.

Preferably said inorganic material has a lower thermal expansion coefficient than said semiconductor material and said layer is prepared on (e.g. grown on or deposited on) said substrate at a defined temperature which is higher than the operational temperature of said switch.

Preferably the step of so stressing said layer includes cooling said layer and said substrate below said defined temperature prior to said step of removing semiconductor material from said substrate.

Said step of so stressing said layer may include preparing said layer of inorganic material as a first and a second layer of inorganic material, said first layer having a different thermal expansion coefficient from said second layer. Said first and/or said second layer may be patterned to enhance said pre-bias in said direction of doming.

Alternatively said step of so stressing said layer may include treating said one side of said substrate prior to preparing said layer of inorganic material such that said one side is not planar. Preferably said step of treating said one side of said substrate consists of producing a recess in said one side.

Embodiments of the invention will now be described by way of example and with reference to the accompanying drawings in which.

Figure 1:
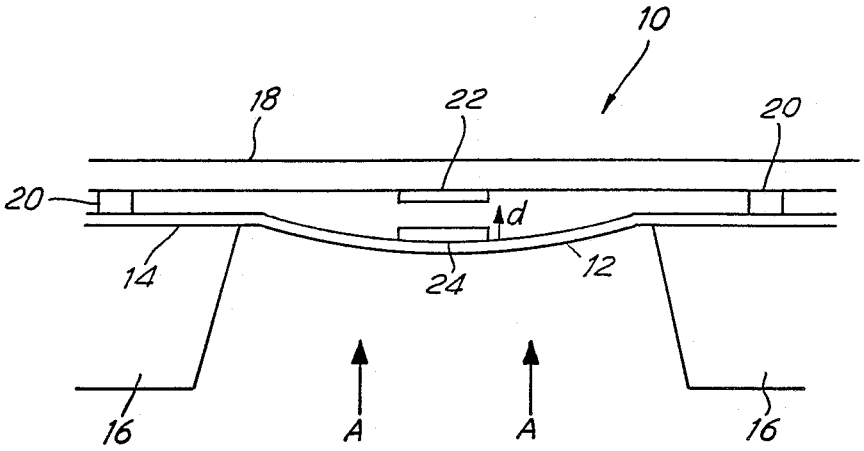
FIG. 1 is a sectional view of a pressure switch having a pressure responsive domed diaphragm in accordance with the invention.

FIG. 1 shows a pressure switch 10 in its open position having a pressure-responsive domed diaphragm 12 comprising a layer of inorganic material 14 grown on a silicon substrate 16. A back-plate 18 of glass is separated from and sealed to the layer of inorganic material 14 by spacers 20. Electrical contacts 22, 24, which may be of gold, are mounted on opposing faces of the back-plate 18 and the domed diaphragm 12. The diaphragm 12 is responsive to applied pressure in the sense indicated by the arrows A.

Figure 2:
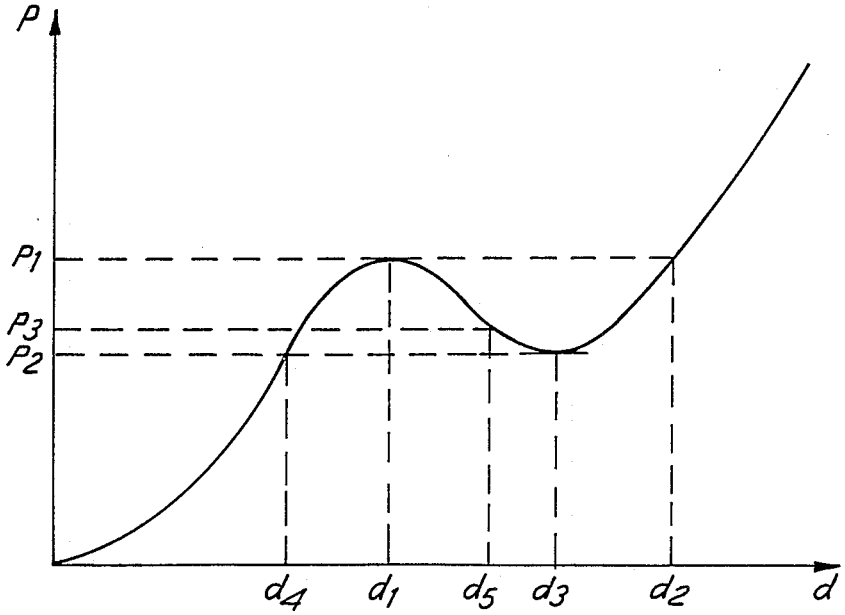
FIG. 2 is a graph of the pressure-deflection characteristics of the diaphragm of FIG. 1.

The deformation characteristics of the domed diaphragm 12, without any restriction, are shown in FIG. 2, where d is the deflection of the diaphragam from its rest state, corresponding to the switch of FIG. 1 in its open position as shown in FIG. 1, and P is the applied pressure differential across the diaphragm. As pressure is applied, the deflection d of the diaphragm from its rest state increases gradually, until a pressure $P_1$, corresponding to a deflection $d_1$, is reached. Any further increase in pressure produces a snap-action deflection from $d_1$ to $d_2$, corresponding to the switch of FIG. 1 being caused to close. Further increase in pressure produces a small gradual increase in deflection d. If the pressure is reduced, the deflection d gradually reduces until a pressure $P_2$ corresponding to a deflection $d_3$ is reached. Any further decrease in pressure produces a snap-action deflection from $d_3$ to $d_4$, corresponding to the switch of FIG. 1 being caused to open.

The pressure-deflection characteristic of the diaphragm involves a hysteresis effect, i.e. the value of differential pressure at which snap-action occurs depends upon whether the pressure is increasing or decreasing. The hysteresis effect depends on various factors including the thickness of material of the diaphragm and its deviation from the planar state. The diaphragm is pre-biased in that snap-action deflection from $d_3$ to $d_4$ is caused by a reduction in the applied pressure rather than an application of pressure in the opposite sense.

When the diaphragm 12 is incorporated into the pressure switch 10, deflection of the diaphragm 12 away from its rest state is limited, by the back-plate 18 acting as a backing member, to a deflection $d_5$ intermediate $d_1$ and $d_2$, preferably intermediate $d_1$ and $d_3$.

When the deflection $d_5$ is intermediate $d_1$ and $d_3$, this corresponds to a state in which the diaphragm is stable with respect to change in deflection in one sense (i.e. increasing deflection) and unstable with respect to change in deflection in the opposite sense (i.e. decreasing deflection). The diaphragm remains in this state only when there is an applied pressure differential greater than $P_3$ across the diaphragm. The pressure switch 10 is accordingly switched on by an increase in pressure greater than $P_1$ and switched off by a reduction in pressure below $P_3$.

When $d_5$ is intermediate $d_3$ and $d_2$, the diaphragm is held in contact with the backing member when the applied pressure differential is greater than a pressure, say $P_4$. It moves away from the backing member when the applied pressure differential falls below $P_4$ and is switched, with a snap-action deflection when the applied pressure differential falls below $P_2$. At a pressure $P_5$, intermediate $P_2$ and $P_4$, the diaphragm and backing member are sufficiently separated for there to be no electrical contact. The pressure switch is accordingly switched on by an increase in pressure greater than $P_1$ and switched off by a reduction in pressure below the pressure $P_5$.

The doming of the diaphragm ensures that the switch is closed by snap action when the pressure $P_1$ is reached and opened, with a snap-action, when the pressure is reduced below a pressure intermediate $P_3$ and $P_2$, but dependent on the position of the backing member. The preferred limitation of $d_5$ between $d_1$ and $d_3$ reduces the amount of stretch and therefore strain on the diaphragm.

The provision of the back-plate 18 also overcomes the problem of 'punch-out' of the diaphragm which may occur if the applied pressure is too high. This can be particularly important in certain applications.

FIG. 3 shows, schematically, steps in the formation of the domed diaphragm 12 according to one method to produce a pressure-deflection characteristic as shown in FIG. 2.

Figure 3A:
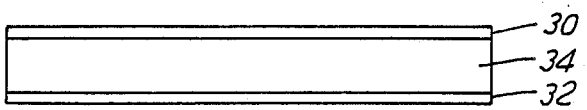
FIG. 3 shows, schematically, steps in the formation of the diaphragm of FIG. 1 according to a first method.
Figure 3B:
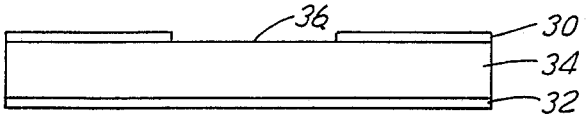
Figure 3C:
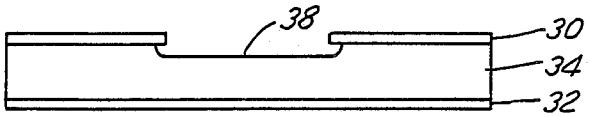
Figure 3D:
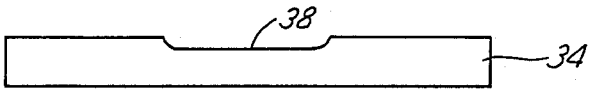

In FIG. 3*a*, silicon dioxide ($SiO_2$) layers 30, 32 have been grown on both sides of a silicon substrate 34. This is accomplished by a thermal oxidation process such as the exposure of the silicon substrate 34 to an elevated temperature of 1000° C. to 1200° C. in an oxygen-rich environment. The $SiO_2$ layer 30 is then patterned and etched by standard masking, photoresist and etching techniques to expose a region 36 of silicon as shown in FIG. 3*b*. Isotropic etching of the exposed silicon 36 using e.g. CP4 (a mixture of nitric, hydrofluoric and acetic acids) produces a recess 38 in the silicon substrate 34 as shown in FIG. 3*c*. The $SiO_2$ layers 30, 32 are then removed, leaving the silicon substrate 34 as shown in FIG. 3*d* with an accurately defined recess 38. The purpose of the $SiO_2$ layer 30 is to act as a mask to define the etching of the silicon as standard photoresist cannot be used directly on the silicon substrate.

Figure 3E:
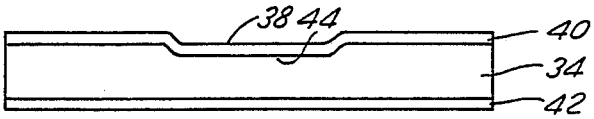

The next step is the growth of $SiO_2$ layers 40, 42, as shown in FIG. 3*e*, by exposure of the silicon substrate 34 with the recess 38 to an elevated temperature of 1000° C. to 1200° C. in an oxygen-rich environment. The thickness of the $SiO_2$ layers 40, 42 can be precisely controlled, since the oxidation rate for silicon as a function of temperature is well-known. Even growth of $SiO_2$ produces a recessed region 44 in the $SiO_2$ layer 40 next to the recess 38 in the silicon substrate 34. As the thermal expansion coefficient of silicon is much greater than that of $SiO_2$, the cooling of the substrate 34 and $SiO_2$ layers 40, 42 after the preparation of the $SiO_2$ layers 40, 42 produces compressional stresses in the $SiO_2$ layers.

Figure 3F:
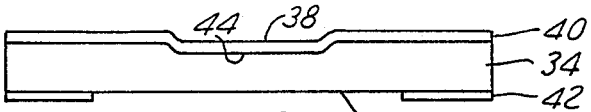
Figure 3G:
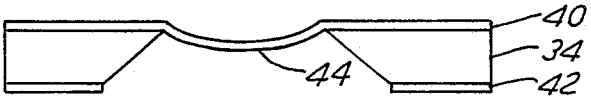

The $SiO_2$ layer 42 on the side of the silicon substrate 34 that does not contain the recess 38 is then patterned and etched by standard masking, photoresist and etching techniques to expose a region 46 of silicon, as shown in FIG. 3*f*. The exposed region 46 of the silicon substrate 34 is anisotropically etched, using e.g. EDP (Ethylene diamine pyrocatechol) or potassium hydroxide solution, to remove the silicon surrounding the recessed region 44 in the $SiO_2$ layer 40 as shown in FIG. 3*g*. This allows the compressional stresses in the $SiO_2$ layer 40 to be released by the recessed region 44 taking up a domed configuration with a pre-bias, caused by the original formation of the recessed region 44, in the direction of doming. The recessed region 44 of the $SiO_2$ layer 40 forms the diaphragm 12 of the pressure switch 10.

The amount of pre-bias (of which a measure is the value of $P_2$, (as shown on FIG. 2) may be controlled by the depth of the recessed region 44. The switching point, i.e. the value of $P_1$, may be controlled by the thickness and area of the diaphragm 12.

In a typical example of a diaphragm produced according to this method, its dimensions are a thickness of 1μm and an area of 1 mm, the depth of the recessed region used is a few micrometers and the values of $P_1$ and $P_2$ are in the order of tens of p.s.i.

FIG. 4 shows schematically steps in the formation of the domed diaphragm according to a second method to produce a pressure-deflection characteristic as shown in FIG. 2.

Figure 4A:
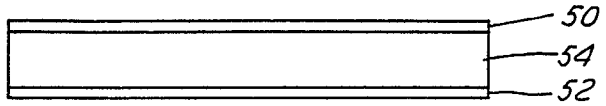
FIG. 4 shows, schematically, steps in the formation of the diaphragm of FIG. 1 according to a second method.
Figure 4B:
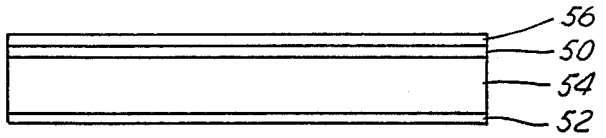

In FIG. 4*a*, $SiO_2$ layers 50, 52 have been grown on both sides of a silicon substrate 54 by a thermal oxidation process such as described hereinbefore. A layer 56, of silicon nitride ($Si_3N_4$) chosen for its thermal expansion coefficient which is similar to but not exactly the same as that for $SiO_2$, is then deposited on top of the $SiO_2$ layer 50 as shown in FIG. 4*b*.

As in the first method, the cooling of the substrate 54 and layers 50, 56 after the deposition of the $Si_3N_4$ layer 56 produces compressional stresses in the layers 50, 56.

Figure 4C:
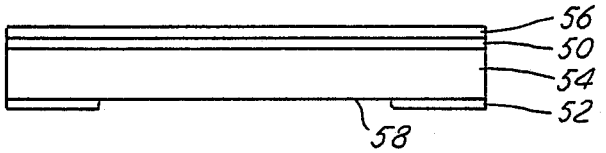
Figure 4D:
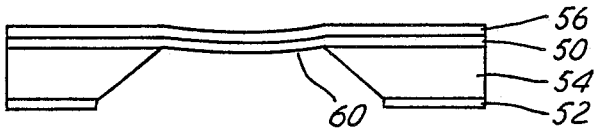

In the next step, the result of which is shown in FIG. 4*c*, the exposed $SiO_2$ layer 52 is patterned and etched to expose a region 58 of silicon substrate. This exposed region 58 is anisotropically etched to remove silicon surrounding a region 60 whose area and position is defined by the exposed region 58. This allows the compressional stresses in the layers 50, 56 to be released by the defined region 60 taking up a domed configuration forming a diaphragm 12. A pre-bias in the direction of doming is produced because the thermal expansion coefficients of $Si_3N_4$ and $SiO_2$ are not exactly the same, so that the compressional stresses produced in the layers 50, 56 by the cooling are different, producing a tendency to bend. The pre-bias may be enhanced by patterning the $Si_3N_4$ layer 56, which can be accomplished prior to anisotropic etching of the exposed region 58 of the silicon substrate 54, or by patterning the $SiO_2$ layer 50.

In a typical example of a diaphragm produced according to this method, its dimensions are an area of 1 $mm^2$, a diaphragm thickness of the order of micrometers and values of $P_1$ and $P_2$ of the order of tens of p.s.i.

After the diaphragm has been formed, according to either of the methods described herein, a switch contact 24 is applied to the diaphragm by evaporation. The back plate 18 with its switch contact 22 is placed in position and electrical leads (not shown) are also provided to form the switch 10.

It is envisaged that pressure switches provided in accordance with the invention may be formed of any appropriate semiconductor material and inorganic layers which may be processed in a similar manner to silicon. The details of temperatures and etching materials would be those suitable for each material chosen.

The characteristics of the switch may be defined by controlling, inter alia, the thickness of the inorganic layer, the area of the diaphragm, the temperature at which the layers of inorganic material are prepared (which controls the compressional stress in the layers).

Silicon and $SiO_2$ are stable to very high temperatures. However temperature variations will affect the switching behaviour, and accordingly the temperature at which the switch is intended to operate must be considered when designing the diaphragm area, thickness etc.

The amount of doming (as characterised by e.g. the separation of $d_1$ and $d_2$) is dependent on the difference between the temperature $T_1$ at which the layers of inorganic material are grown or deposited on the substrate and the operating temperature. As the operating temperature rises towards $T_1$ (about 1000°–1200° C.) the amount of doming decreases and the snap-action response decreases accordingly.

However it is envisaged that a switch provided in accordance with the invention could be operated at temperatures up to, say, 800° C., depending on how the switch is packaged. Higher possible operating temperatures are envisaged if the switch is prepared by the first method hereinbefore described.

Variations in the methods described hereinbefore will be evident to those skilled in the art. For example, the layers of inorganic material, may be prepared on the substrate by various methods including growing (as described) or deposition.

It is to be noted that if the substrate and inorganic layers are cooled too quickly, in the extreme case, the layers of inorganic material could be thermally shocked and tend to crack.

We claim:

1. A micro-engineered fluid pressure actuated switch including a domed diaphragm undergoing a snap-action response, wherein a first electrical contact is provided on a backing member of said switch and a second electrical contact is provided on said diaphragm so as to cooperate with the first electrical contact, said snap action response being to an applied fluid pressure differential across said diaphragm and thereby causes said contacts to make or break, and wherein said diaphragm is supported on a substrate of semiconductor material.

2. A switch according to claim 1 wherein said diaphragm is biased resiliently in the direction of doming and said defined states include a first state and a second state, whereby, in use, said diaphragm is displaced to said second state by the application of pressure and returns to said first state upon removal of the applied pressure.

3. A switch according to claim 2 wherein said second state is stable with respect to change in deflection of the diaphragm in one sense and unstable with respect to change in deflection of the diaphragm in the opposite sense, said diaphragm remaining in said second state only when there is an applied pressure differential across said diaphragm.

4. A switch according to claim 3 wherein the extent of deflection of said diaphragm when pressure is applied is limited by a backing member.

5. A switch according to claim 4 wherein said first and second electrical contacts are in contact when said diaphragm is in said second state.

6. A switch according to claim 1 wherein said diaphragm consists of a first and a second layer of inorganic material, said first layer having a different thermal expansion coefficient from said second layer.

* * * * *